US006643990B2

(12) United States Patent
Jensen

(10) Patent No.: US 6,643,990 B2
(45) Date of Patent: Nov. 11, 2003

(54) MODULAR MOLDING SYSTEM

(76) Inventor: James Jensen, 35 Riverview Ct., Secaucus, NJ (US) 07094

( * ) Notice: Subject to any disclaimer, the term of this patent is extended or adjusted under 35 U.S.C. 154(b) by 0 days.

(21) Appl. No.: 09/945,778

(22) Filed: Sep. 4, 2001

(65) Prior Publication Data

US 2003/0093970 A1 May 22, 2003

Related U.S. Application Data

(63) Continuation-in-part of application No. 09/473,591, filed on Dec. 29, 1999.

(51) Int. Cl.[7] ..... E04C 2/38

(52) U.S. Cl. ..... 52/716.1; 52/718.01; 52/716.8; 52/717.01; 52/716.1; 52/287.1; 52/288.1; 52/726.1

(58) Field of Search ..... 52/717.05, 718.01, 52/716.8, 717.01, 716.1, 287.1, 288.1, 726.1

(56) References Cited

U.S. PATENT DOCUMENTS

| | | | | | |
|---|---|---|---|---|---|
| 906,218 | A | * | 12/1908 | Goddard | |
| 3,046,616 | A | * | 7/1962 | Sampsell | |
| 3,616,587 | A | * | 11/1971 | Schafly | 52/288 |
| 3,676,974 | A | * | 7/1972 | Daly | 52/716 |
| 4,109,434 | A | | 8/1978 | Katzin | 52/287 |
| 4,829,730 | A | | 5/1989 | Zeilinger | 52/288 |
| 5,199,237 | A | | 4/1993 | Juntmen | 52/288 |
| 5,398,469 | A | | 3/1995 | Logan | 52/288.1 |
| 5,457,923 | A | * | 10/1995 | Logan et al. | 52/288.1 |
| 5,694,726 | A | * | 12/1997 | Wu | 52/287.1 |
| 5,819,485 | A | * | 10/1998 | Lane et al. | 52/287.1 |
| 5,924,259 | A | * | 7/1999 | Marousek | 52/656.1 |
| 5,953,881 | A | * | 9/1999 | Sherry | 52/746.1 |

* cited by examiner

*Primary Examiner*—Carl D. Friedman
*Assistant Examiner*—Steve Varner
(74) *Attorney, Agent, or Firm*—Wolff & Samson PC

(57) ABSTRACT

The modular molding system of the present invention comprises a plurality of modular molding sections for covering the joint formed between a vertical wall and a ceiling to create a crown molding. The sections, preferably formed of a thin plastic vacuum-molded material, include an angled faced portion and a horizontal alignment portion interconnected with the angled face portion. The molding sections include a first straight end and a second angled end. The angled ends are used for forming coped corner moldings, the angled end of one section contacting the face of another section at a right angle. A desired length of linear molding is formed by overlapping the straight end of a first section over the angled end of a second section. This process can be repeated to form a molding of desired length. The molding sections are flexible to abut to an uneven surface of a vertical wall. The horizontal alignment portion carries an adhesive which allows the molding to be adhered to a ceiling. The horizontal alignment portion has a dual purpose of providing a surface for carrying the adhesive, as well as providing a means for easily insuring that the molding is properly spaced from a vertical wall.

16 Claims, 9 Drawing Sheets

(EXAGGERATED)

MODULAR MOLDING SYSTEM

RELATED APPLICATION

This application is a continuation-in-part application of U.S. patent application Ser. No. 09/473,591, filed Dec. 29, 1999 by James Jensen, entitled Modular Molding System, the entire disclosure of which is expressly incorporated herein by reference.

BACKGROUND OF THE INVENTION

1. Field of the Invention

The present invention relates generally to a modular molding system which utilizes molding segments that can be attached together to form a molding of desired length. More particularly, the present invention relates to a modular molding system having thin plastic segments that can be interconnected together and attached to a ceiling to form a crown molding, with corners, for a room.

2. Related Art

Crown moldings are commonly used to decorate a room by providing a transition between the joint formed by a vertical wall and a ceiling. Typically, crown moldings used for this purpose have been made of wood. However, the high costs associated with wood moldings make them cost prohibitive for lower budget rooms, such as office spaces, basements, etc. As such, efforts have been made to develop moldings which can be economically installed to decorate a lower budget room. Additionally, the installation of wood crown moldings is highly time intensive which adds to the cost. For example, the wood molding must be formed, possibly by interconnecting various wood molding elements, to form a desired molding profile. Then, the wood molding must be properly sized for the location it is to be used. This sizing typically requires a compound mitre saw which can be expensive, require a significant amount of training before use, and involve a significant amount of time to use. Further, use of such a saw creates significant amounts of sawdust, which adds to the inconvenience associated with installation, and which can also be a health hazard.

In order to reduce the time and inconvenience associated with installation of crown moldings, efforts have been made to develop single-form composite moldings with double-faced adhesive which can stick to the vertical walls and be held in place. However, despite the improvements of economy and efficiency of installation provided by composite moldings, current designs are still hampered by a multitude of components which must be interconnected together in various forms to form a length to cover a wall and/or a corner section. The multitude of required different pieces also significantly adds to the cost of production. Accordingly, what is desirable, and has not heretofore been developed, is a modular molding system which has the desired benefits of economy and ease of installation, with the added advantages of simplicity of design and construction.

Several of the numerous past efforts to molding designs include:

Lane et al., U.S. Pat. No. 5,819,485, discloses a molding system which is manufactured from a polystyrene foam base, with a foam-coating on top of the foam base. The foam coating is covered by a second layer of gypsum. The foam base can easily be made in a desired shape. The gypsum or "drywall" material second layer can be sanded to achieve the desired appearance. The molding system, comprising sections of the foam base, and layers of foam-coat and gypsum can then be attached to a wall or ceiling with glue or screws.

Logan, et al., U.S. Pat. No. 5,457,940, discloses a decorative trim or molding system, which can be placed in a corner which joins a vertical wall and a ceiling. A molding section is attached to a wall track—said wall track being first mounted to the wall by nails or other fasteners—by a plurality of clips. Alternatively, the molding sections can be affixed in said position by an adhesive, such as double-sided pressure sensitive tape, positioned against a vertical wall. (FIG. 8) A plurality of molding sections can be placed together in order to cover a lineal length of wall. The molding sections are telescopically, slidingly intermitted to one another, and in one embodiment are further secured together by spring tabs integrally formed on the molding section. The moldings, once affixed to the vertical wall, can extend outwardly from the wall, and fit in close contact with the ceiling to provide a resilient fit with both the wall and the ceiling, and give the appearance of an angled corner molding. The patent discloses sections of molding formed in thin flexible strips from polystyrene. The sections are flexible in both the horizontal and vertical directions to allow the molding to conform to uneven surfaces of the wall and ceiling. The patent further provides for corner sections which are adhesively engaged in an overlapping arrangement to form the corners where two vertical walls meet the ceiling and each other, thus alleviating the need for mitering the ends of the molding.

Logan, U.S. Pat. No. 5,398,469, is the parent application to Logan, et al. '940, and discloses essentially the same elements but with fewer embodiments.

Juntunen, U.S. Pat. No. 5,199,407, discloses a corner molding formed of a single piece of material, preferably foam or plastic, which can be placed in a corner overtop two rough cut lineal sections of molding. The single-piece corner molding gives the appearance of two perfectly joined lineal sections without the mitering and precision typically required to join separate lineal pieces in a corner.

Zeilinger, U.S. Pat. No. 4,862,710, discloses a molding system to cover the joint formed between a counter top and an adjacent vertical surface. The molding is essentially L-shaped with a concave outer surface, and an almost perpendicular inner surface which is affixed to the counter top and vertical wall by double faced adhesive. The patent further discloses three types of joinder pieces: 1) corner pieces which can be affixed overtop two molding sections which meet at right angles, 2) extension pieces which combine two molding sections in a lengthwise fashion, and 3) end pieces which can be placed overtop and end section of molding which meets a second vertical wall. All three of these joinder pieces are provided to make transitions in the molding appear continuous and as a result, more aesthetically pleasing.

Katzin, U.S. Pat. No. 4,109,434, discloses a combination baseboard molding which incorporates a baseboard molding and shoe molding into one structure. Typically, in order to cover the crack between a floor and a vertical wall, a first rigid baseboard molding is applied, and then a second shoe molding which is of adequate flexibility is affixed in the corner adjacent to the baseboard and the floor. The flexibility of the shoe molding allows the combination baseboard shoe design to conform to the design nuances in the area formed by a floor and a vertical wall, so that it appears that there is a smooth transition between the floor and a vertical wall. The patent discloses a combination baseboard and flexible shoe which can be affixed to the corner in one step, rather than two-step process described above.

Schlafly Jr., U.S. Pat. No. 3,616,587, discloses decorative moldings designed to economically hide unsightly wires which are often added to homes and other dwellings following construction. Such post-construction wiring could include connections for emergency lights, cable and other communication lines, etc. The patent generally discloses brackets which can be affixed to a wall by an adhesive. The brackets are generally L-shaped with the perpendicular legs of the joint extending outwardly from the corner formed by a ceiling and vertical wall. The legs of the brackets have hooks for receiving a tempered aluminum slat, which serves to cover the wiring behind it. The legs of the brackets are fixed closer together than the width of the slat so that the slat is flexibly bent into the hooks and resiliently held therein. Preferably, a series of brackets, typically formed from the same material as the slat, are used to support the slat.

None of the previous efforts in this area, taken either alone or in combination, teach or suggest all of the benefits and the utility of the present invention.

OBJECTS AND SUMMARY OF THE INVENTION

It is a primary object of the present invention to provide a modular molding system.

It is another object of the present invention to provide a modular molding system comprising sections formed of thin plastic.

It is even another object of the present invention to provide thin plastic molding sections for a modular system, which sections are formed by vacuum molding.

It is still another object of the present invention to provide thin plastic moldings which include an angled face portion and a horizontal alignment portion.

It is still another object of the present invention to provide a molding system having molding sections which have a first straight end and a second angled end.

It is an additional object of the present invention to provide a molding system which can be used to form corners by overlapping the straight end of one section with the angled end of another section.

It is a further object of the present invention to form a molding of a desired length by overlapping a straight end of a first molding section over an angled section of a second molding section, and continuing to overlap additional molding sections in a like manner to create a molding of desired length.

It is a further object of the present invention to attach two overlapping molding sections together by means of adhesive on an interior side of the angled face portions of the molding sections.

It is a further object of the present invention to provide modular molding sections having a horizontal alignment portion which allows for the molding to be properly placed the correct distance away from, and parallel to, a vertical wall.

It is a further object of the present invention to provide an adhesive on the upper surface of the horizontal alignment portion to adhere the molding section to a ceiling.

It is a further object of the present invention to provide a thin plastic molding which is flexible in order to easily adjust to uneven wall surfaces.

It is even a further object of the present invention to provide molding sections that can be overlapped to form a molding of a desired length, the molding sections having a drift in size along the length from one end to the other so that the larger end can overlap the smaller end of an adjacent molding section.

The modular molding system of the present invention comprises a plurality of modular molding sections for covering the joint formed between a vertical wall and a ceiling to create a crown molding. The sections are preferably formed of a thin plastic vacuum-molded material. The molding sections include an angled faced portion and a horizontal alignment portion interconnected with the angled face portion. The molding sections include a first straight end and a second angled end. An angled end overlays a straight end positioned at a corner to form a coped corner. A desired length of molding is formed by overlapping the straight end of a first section over the angled end of a second section to give the appearance of a straight joint, or even no joint. This process can be repeated to form a molding of desired length. An adhesive may be provided on the inner surface of the angled section of the molding sections in order to allow for overlapping sections to be adhered together. The molding sections are flexible to abut to an uneven surface of a vertical wall. The horizontal alignment portion carries an adhesive which allows the molding to be adhered to a ceiling. The horizontal alignment portion has a dual purpose of providing a surface for carrying the adhesive, as well as providing a means for easily insuring that the molding is properly spaced from the vertical wall.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The modular molding system of the present invention provides an effective and efficient means for covering the joint formed between a ceiling and vertical wall, i.e. forming a crown molding. The modular thin molding system comprises a plurality of modular sections. The sections are comprised of a decorative angled face portion and a horizontal alignment portion. Additionally, each section includes an angled end and a straight end, as will be described.

Figure 1:
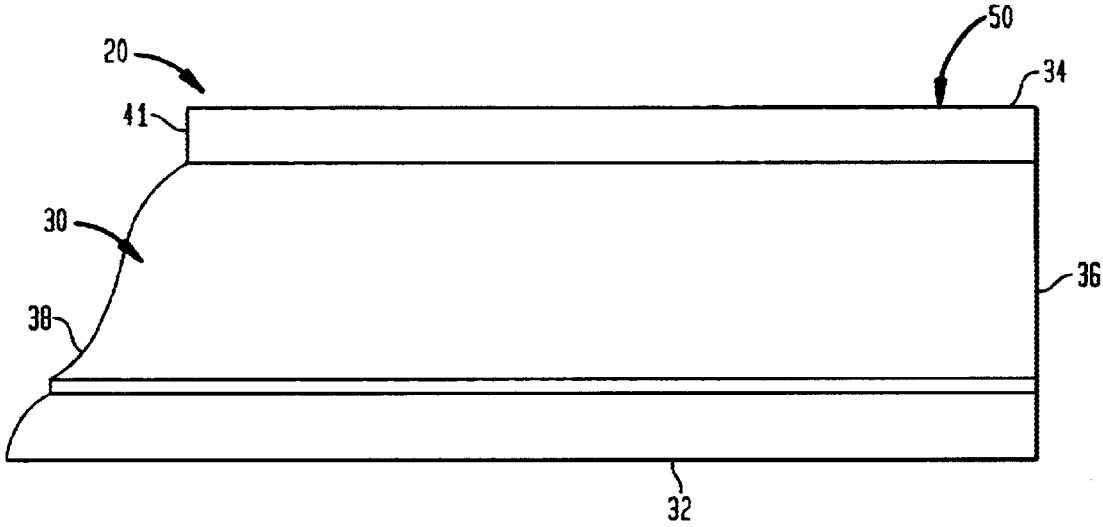
FIG. 1 is a front plan view of a modular thin molding section of the present invention.
Figure 2:
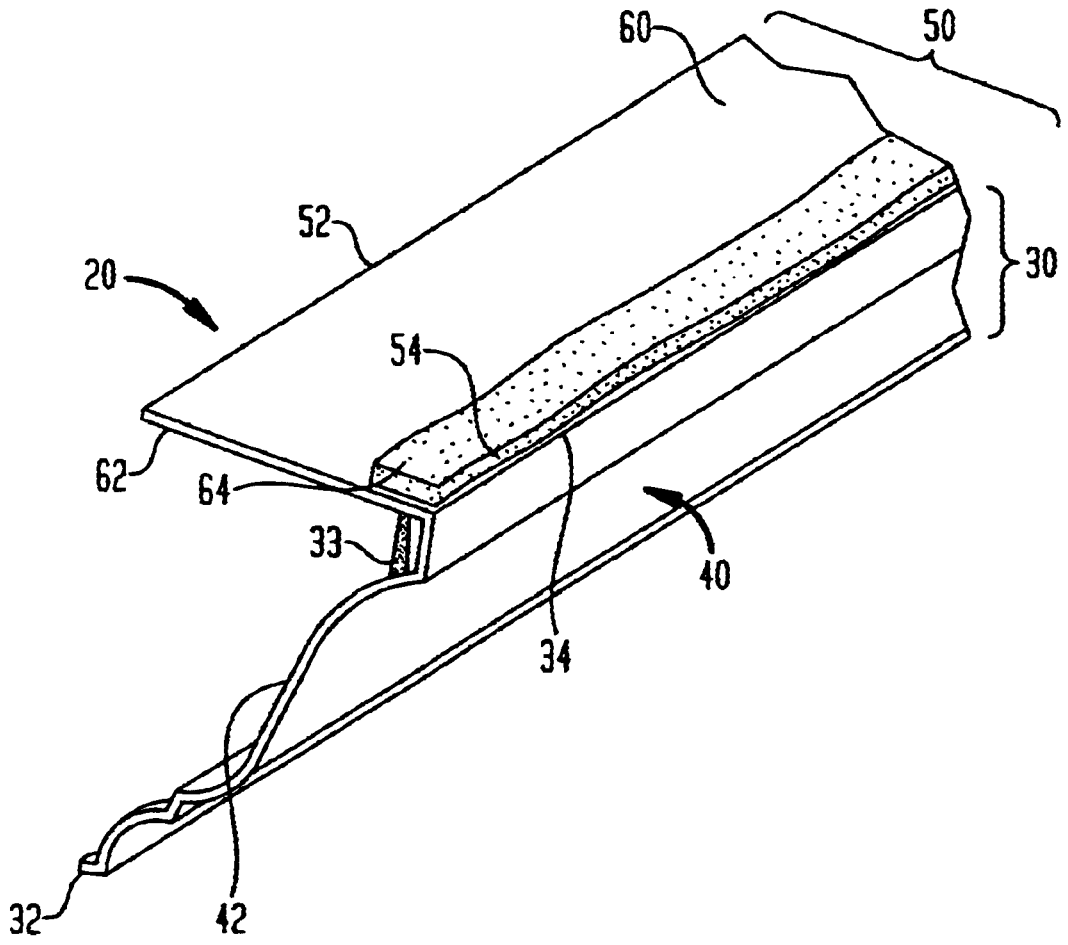
FIG. 2 is a partially cut-away perspective view of the modular thin molding section shown in FIG. 1.

FIGS. 1 and 2 show a section of the modular thin molding system of the present invention, generally indicated at 20. The molding section 20 comprises an angled face 30, and a horizontal alignment portion 50. The angled face 30 includes a lower edge 32 and an upper edge 34. The lower edge 32, in use, abuts against a vertical wall 12. The horizontal alignment portion 50 includes a contact edge 52 for abutting a vertical wall, and a forward edge 54 which is joined with the upper edge 34 of the angled face 30.

The angled face 30 has a first straight end 36 and a second angled or coped end 38. The angled end 38 is defined by an edge extending from an angled point 41 to the lower edge 32. The angled end 38 is useful for forming corner moldings as will be described. The straight end 36 of one section 20 can overlap the angled end 38 of an adjacent section 20 to form a barely visible seam when a length of molding is formed of modular sections as will be described.

Figure 4:
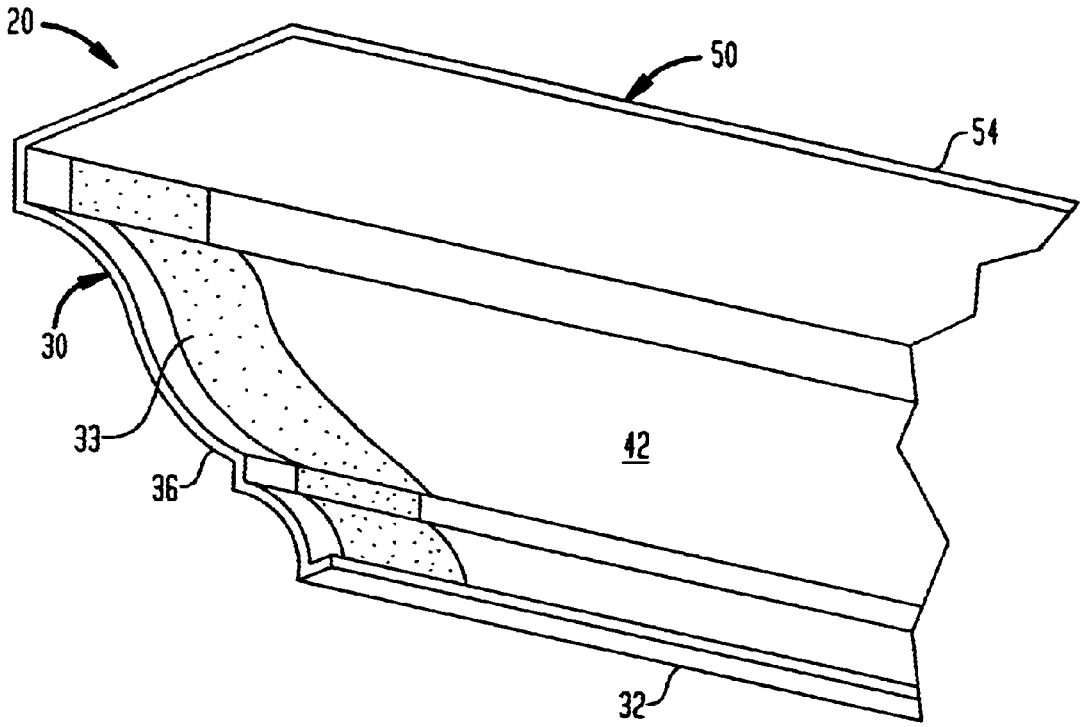
FIG. 4 is a rear perspective view of the modular molding section shown in FIG. 1.

The angled face 30 further comprises an outer angled surface 40 and an inner angled surface 42. As best shown in FIG. 4, a molding adhesive 33 is provided on an inner angled surface 42 to secure attachment of a first molding section 20 to a second molding section 20 to form a desired length of molding. This molding adhesive is preferably very thin. Attachment is achieved by placing the straight end 36 of a second molding section 20 over the angled end 38 of a first molding section 20, and pressing the sections together to adhere the molding adhesive 33 on the inner angled surface 42 of the second molding section 20 to the first molding section.

Figure 3:
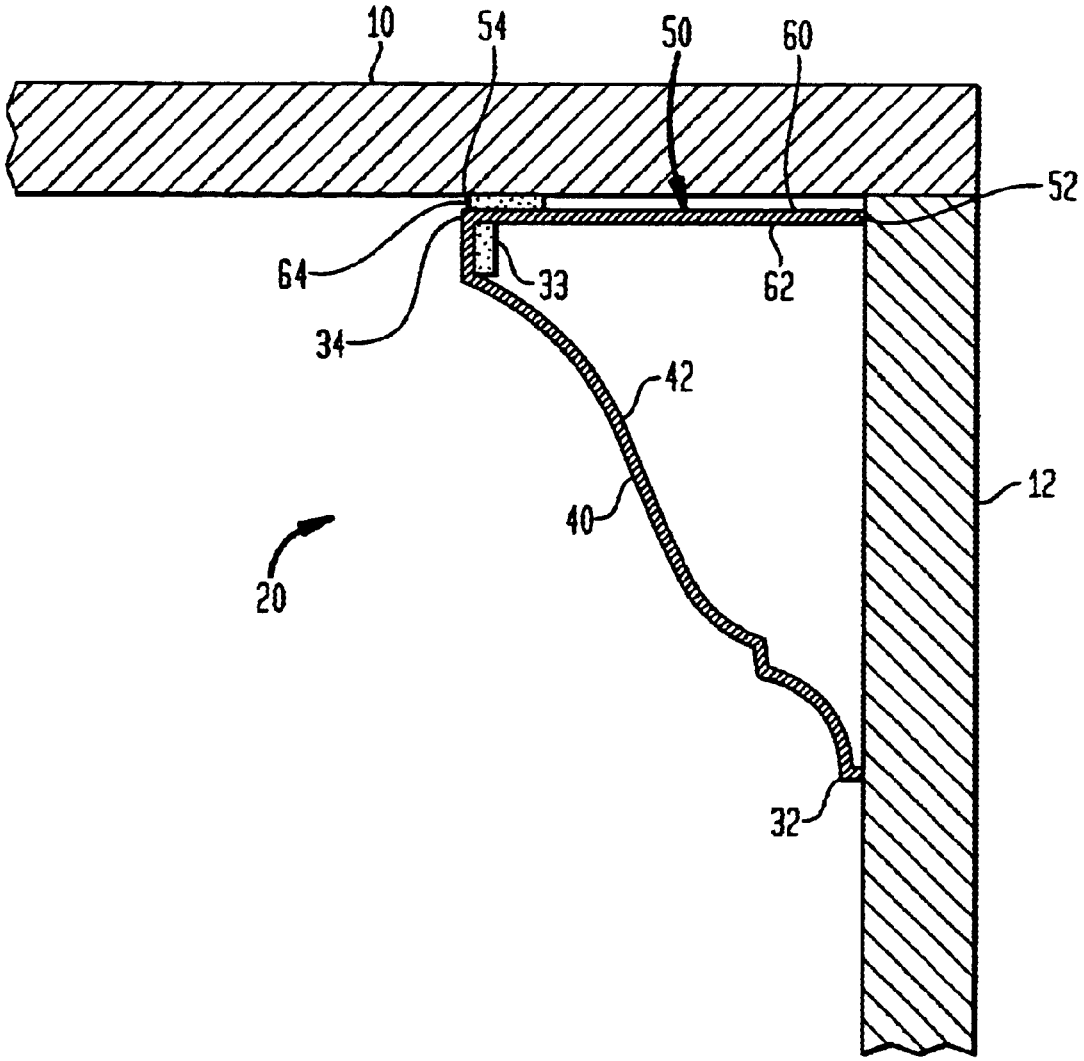
FIG. 3 is a cross-sectional view of a modular thin molding section of the present invention shown in FIG. 1 attached to a ceiling and in position against a vertical wall.

Referring now to FIG. 3, the horizontal alignment portion 50 has first and a second ends, both of which are straight, and an outer surface 60 and an inner surface 62. In use, the contact edge 52 of the horizontal alignment portion 50 contacts the vertical wall 12 and the outer surface 60 extends along a ceiling 10. The outer surface 60 of the horizontal alignment portion 50 carries a ceiling adhesive 64 which adheres to a ceiling 10 and thereby attaches the molding 20 to the ceiling. The adhesive could be positioned along a forward edge of the horizontal alignment portion, but preferably covers all or most of the horizontal alignment portion. A preferred adhesive is the General Purpose Double Coated Tape made and sold by 3M and sold under product no. 9589. Any double stick carpet tape can be used. The horizontal alignment portion 50 runs the entire length of the molding section 20, and insures that the molding section 20 is positioned properly and uniformly from the vertical wall 12, i.e. the joint formed by the upper edge 34 of the angled face 30 and the forward edge 54 of the horizontal alignment portion 50, is positioned a uniform distance away from the vertical wall 12, for a plurality of modular sections 20.

The molding sections 20 are attached by first aligning the contact edge 52 of the horizontal alignment portion 50 with a vertical wall 12, to insure that the molding section 20 is correctly aligned, and then placing pressure on the joint formed between the forward edge 54 of the horizontal alignment portion 50 and the upper edge 34 of the angled face 30 to insure adhesion of the molding section 20 to a ceiling 10. A plurality of molding sections could be first joined together to form a molding of a designed length and then attached to a ceiling, or the molding sections can be attached section by section. The ceiling adhesive is preferably applied on site, either after a length of molding has been formed from a plurality of sections, or on a section by section basis. The ceiling adhesive does not grab the ceiling until it is pressed thereagainst. The molding can be flexed out to allow one to put their hands behind the molding to press it against the ceiling. Molding sections can be easily trimmed to obtain a desired length.

Figure 5:
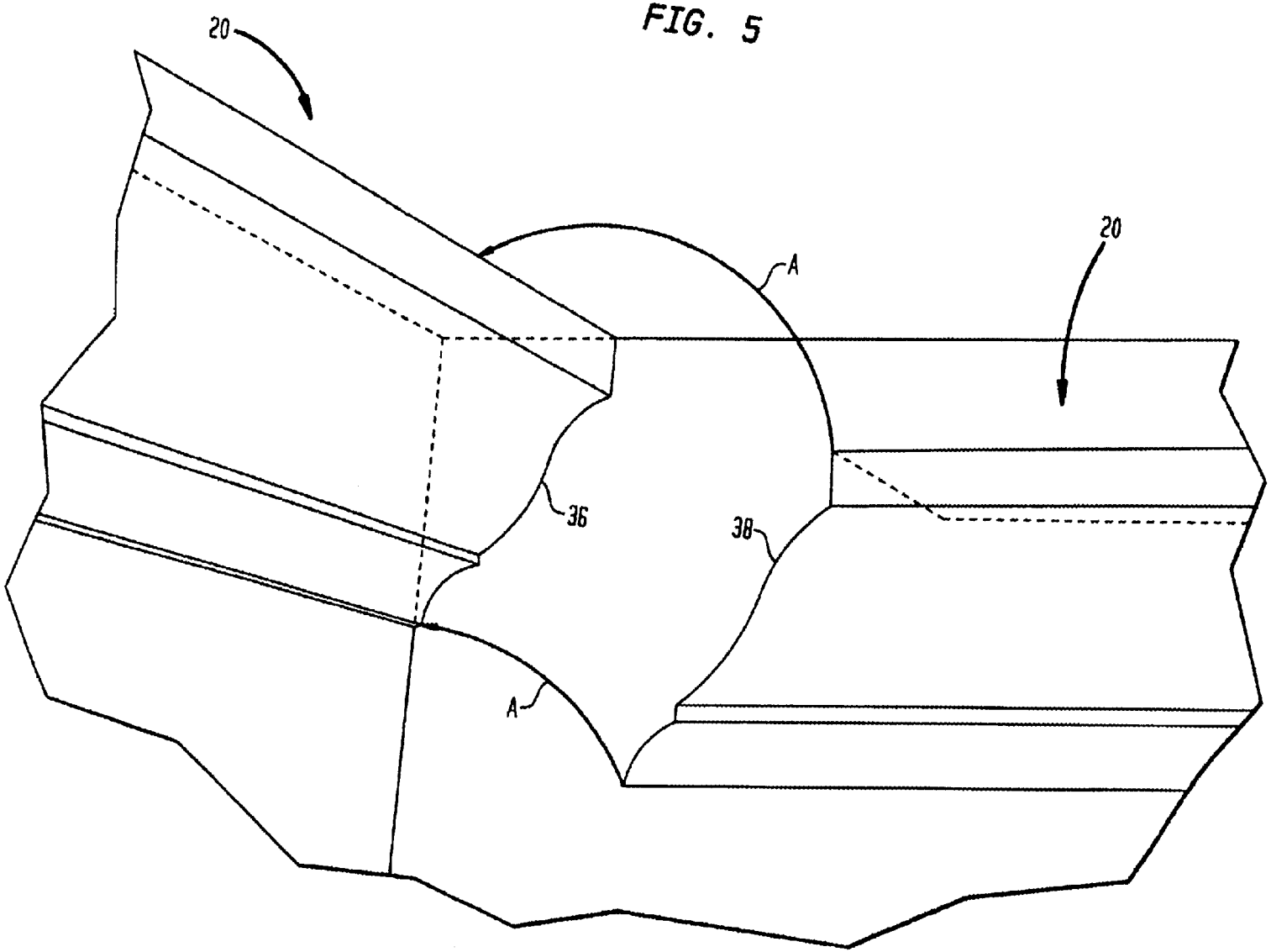
FIG. 5 is a perspective of a molding section positioned against a wall and ceiling in a corner, with a second molding section being positioned thereagainst to form a corner.
Figure 6:
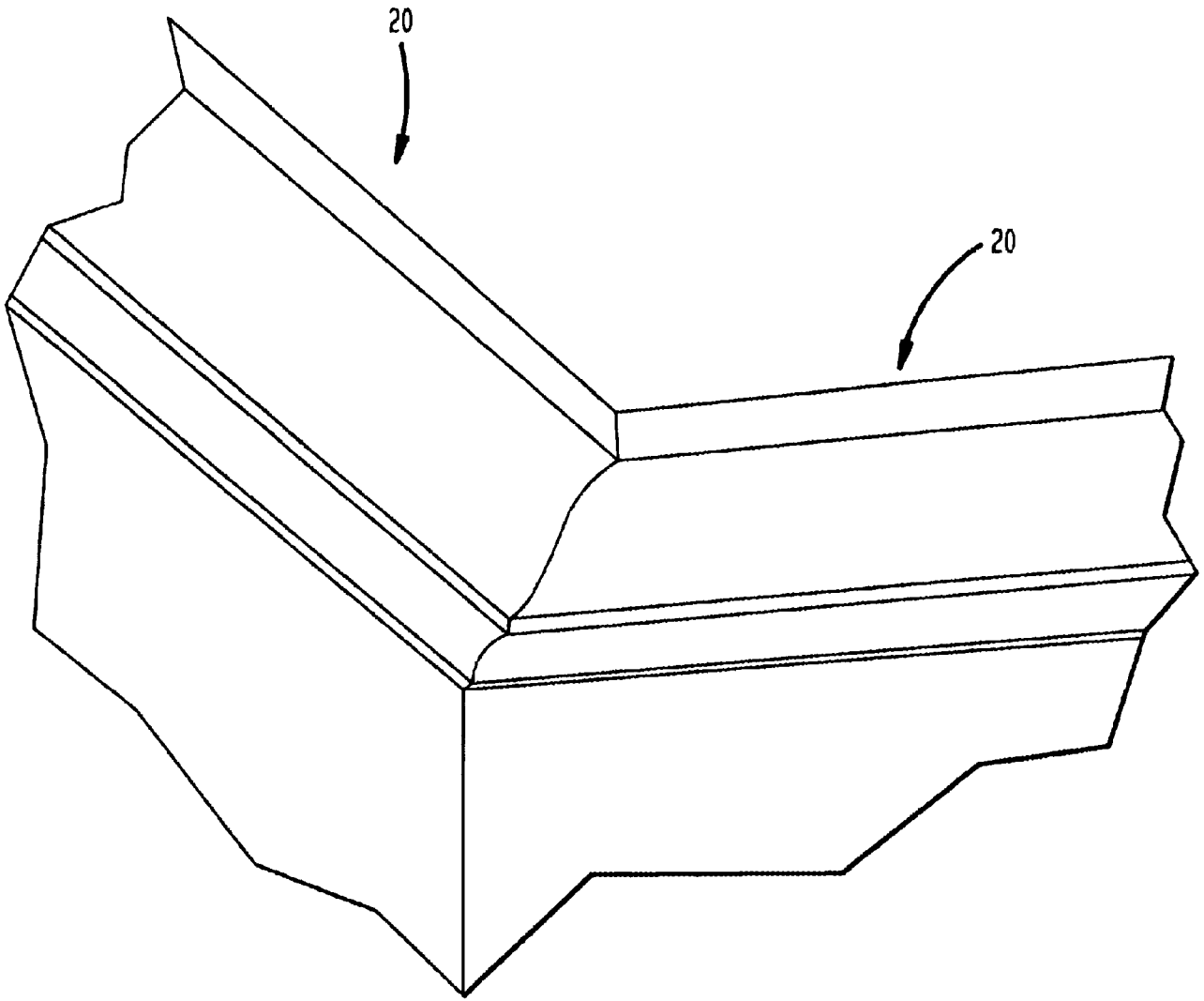
FIG. 6 is a perspective view of a corner formed by two modular thin molding sections.

FIG. 5 shows one molding section in place against a corner. The straight end 36 is against a side wall. The second molding, having an angled or coped end 38 is moved into position against the first section along arrows A to contact the face of the first section and form a coped corner. Normally, to form a coped corner out of wood molding, one must first cut a 45° miter. After that they must back cut the molding with a coping saw following the molding profile, resulting in what is known as a coped cut. By coped, it is meant that the end one section is angled such that it could be placed against the face of another section at 90° to form a corner joint. Also, the horizontal alignment portions 50 properly align the both sections 20 forming the corner 50 that the corner properly matches up, i.e., is properly coped. FIG. 6 shows the completed coped joint formed of two sections 20.

Although the sections can be formed of any suitable material, it is preferable to use a thin plastic material which is lightweight and can be easily adhered to a ceiling 10. The thin plastic design provides rigidity while maintaining flexibility. The flexibility provided allows for the angled face 30 to adjust to the non-uniform smoothness of a vertical wall 12, in order to maintain the lower edge 32 of the angled face 30 in a relatively flush position against a vertical wall 12.

Figure 7:
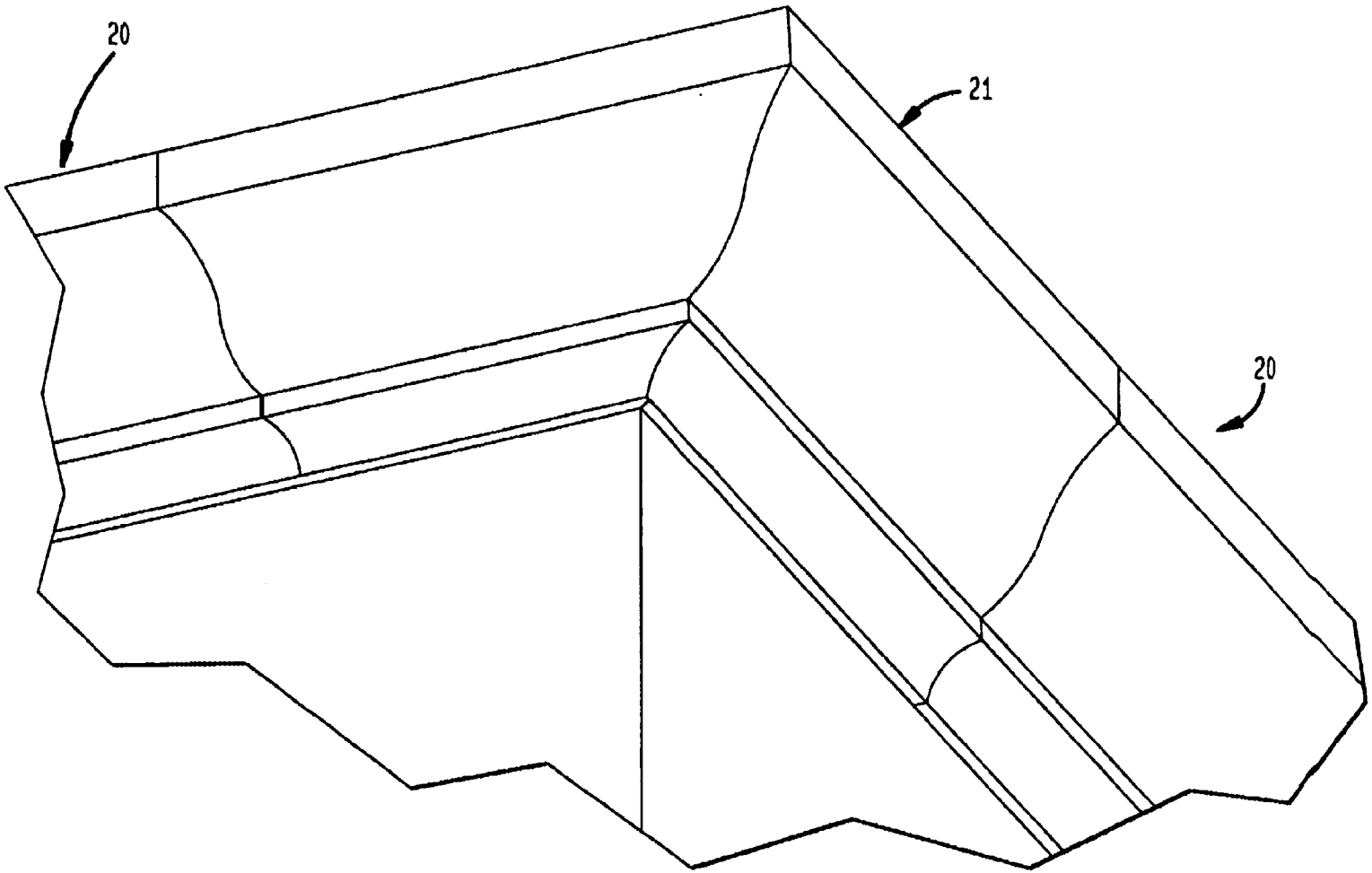
FIG. 7 is a perspective view of an outer corner formed by modular thin molding sections.

FIG. 7 shows an exterior corner joint formed by a corner section 21, and also shows sections 20 forming a length of molding. The corner section 21 is preformed into a desired shape for wrapping about an exterior corner. All other aspects of the corner section 21 are the same as the other section 20. Molding sections 20 are subsequently attached to the ends of the corner section 21 to form a desired length of molding. Also, it should be pointed out that corner section 21 can be trimmed to form an end cap to end a run of molding.

In use, two molding sections 20, can be abutted in a corner to form a corner joint 70. From the corner, additional molding sections 20 can be added to extend in each direction away from the corner, along the ceiling/wall interface, by placing the angled end 36 of a second molding section underneath the straight end 38 of a first molding section 20, to form a straight overlapping joint 72.

Because the moldings can be overlapped in succession to form a length of molding, or abutted together to form a corner molding, only one design of molding is required. Furthermore, it is unnecessary to manufacture different sizes of the design, because individual molding sections can be overlapped to form a desired length, and/or trimmed to size. The simplicity of this design requirements greatly reduces production costs, making the molding sections 20 highly affordable.

Importantly, the horizontal alignment portion 50 of sections 20 provides for proper positioning of the sections relative to the wall/ceiling joints, to corner joints, and to successive section 50. Also, the flexibility of sections allows for the lower edge 32 of the angled face portions 30 to track a wavy wall. While in a preferred embodiment the sections are fabricated of thin plastic, and manufactured in any way known in the art, such as by vacuum forming, it is possible to make the sections any desired exterior surface, i.e., a desired color and/or glossiness. The exterior surfaces of the sections could be covered in paper or otherwise prepared to facilitate the painting thereof.

Figure 8A:
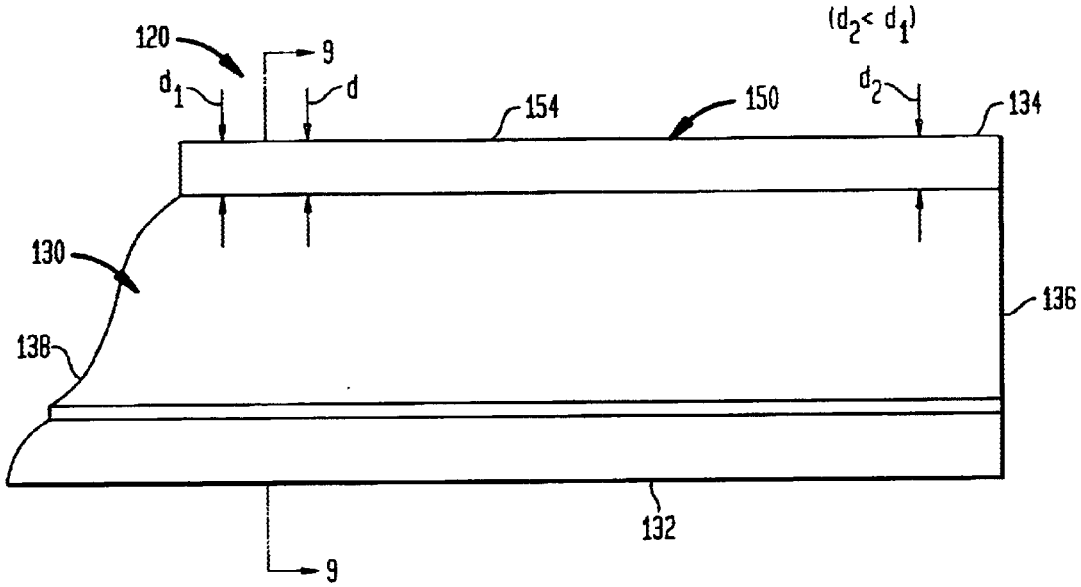
FIG. 8 is another embodiment of the modular thin molding section of the present invention.
Figure 8B:
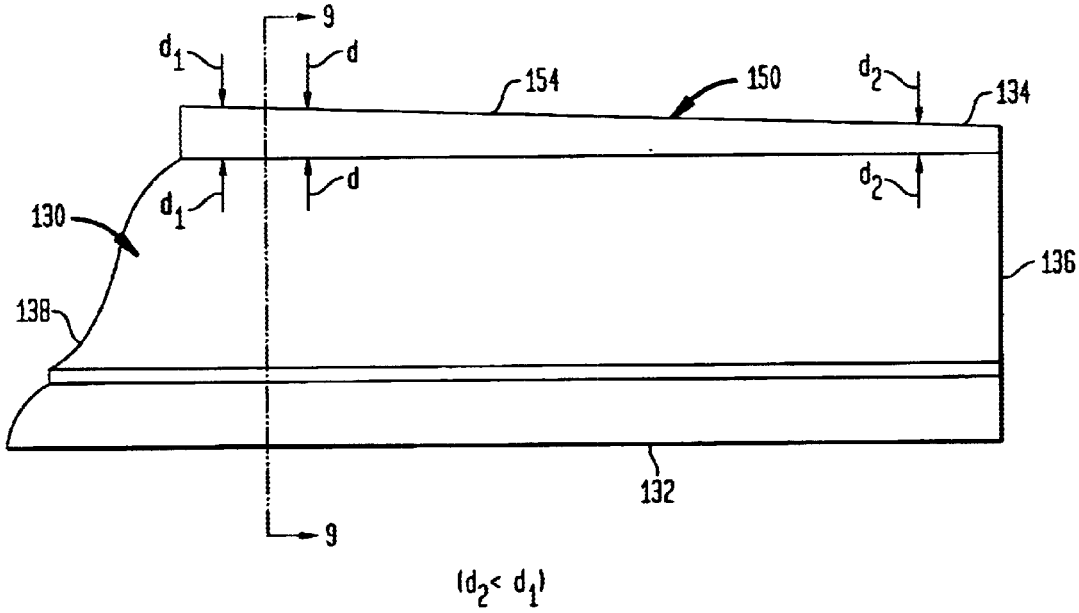
Figure 9:
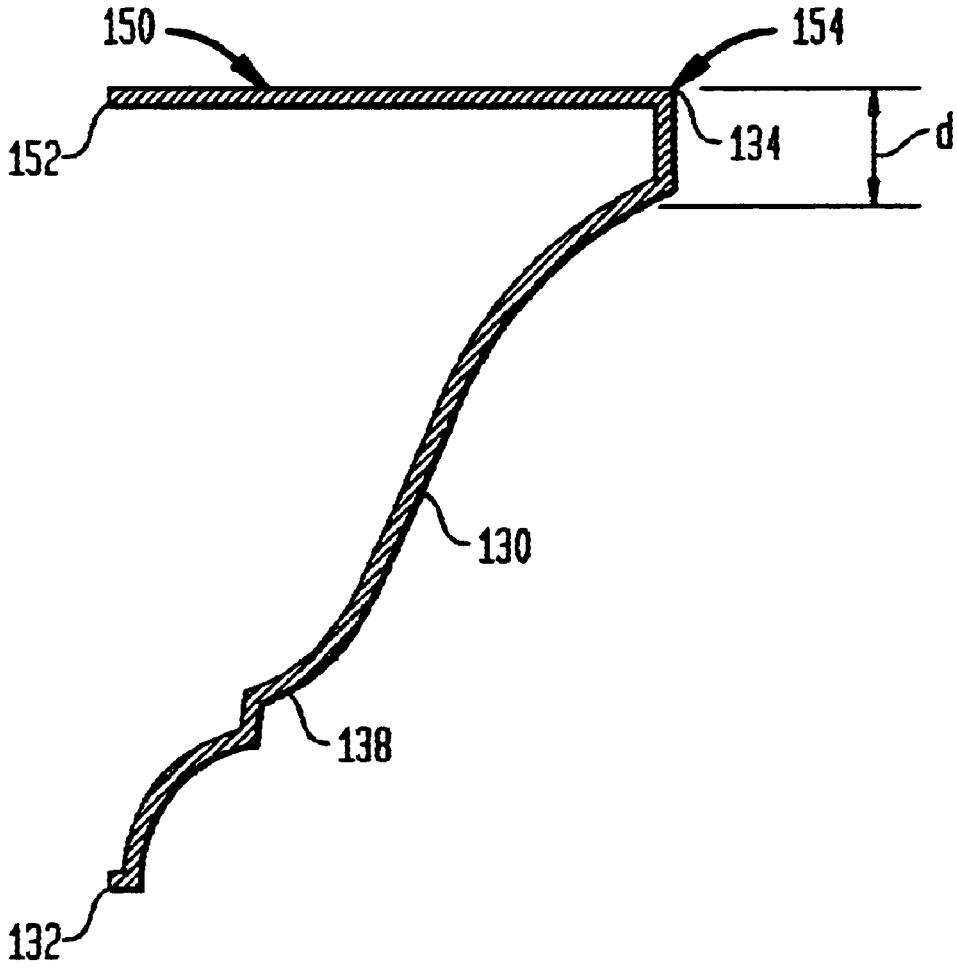
FIG. 9 is a cross sectional view of the molding section shown in FIG. 8 taken along line 9—9.

Referring now to FIGS. 8 and 9, another embodiment of a modular thin molding section of the present invention is generally indicated at 120. The molding section 120 includes an angled face 130 and a horizontal alignment portion 150. The angled face 130 includes a lower edge 132 and an upper edge 134. The lower edge 132, in use, abuts against a vertical wall. The section includes straight edge 136 and angled edge 138. The horizontal alignment portion 150 includes a contact edge 152 for abutting a vertical wall, and a forward edge 154 which meets with the upper edge 134 of the angled face 130.

It has been found that during the sequential overlapping of molding sections is more desirable to overlap the angled edge 138 over the straight edge 136 because the overlap becomes less visible to a casual observer of the molding. It has also been found that in order to minimize the appearance of a seam between overlapping molding sections 130, it is desirable to incorporate a change in dimension over the length of the molding section 130. Indeed, the critical dimension for forming the overlap is the dimension along the upper edge of the angled face, or vertical wall, which is indicated by letter d. Importantly, it is desirable for the size of d1, at the angled edge 138 to be grater at the angled edge than d2 at the straight edge 136. This "drift" along the length of the molding section 130 is minimal and not perceptible to a casual observer of the molding, but allows for the angled edge 138 of the molding section 130 to nest over the straight edge 136 of an adjacent molding section 130 to form an imperceptible seam.

Having thus described the invention in detail, it is to be understood that the foregoing description is not intended to limit the spirit and scope thereof. What is desired to be protected by Letters Patent is set forth in the appended claims.

What is claimed is:

1. A molding section comprising:

an angled face portion having an upper edge, a lower edge, a first end and second end;

horizontal alignment portion having a forward edge, a rear edge, an upper surface and first and second ends, the horizontal alignment portion integrally formed with the angled face portion and joined at its forward edge with the upper edge of the angled face portion; and an adhesive on the upper surface of the horizontal alignment portion for adhering of the molding section to a ceiling;

wherein the dimensions of the molding section at the first end of the molding section are greater than the dimensions of the molding section at the second end of the molding section to allow for the first end of one molding section to overlap a second end of a second molding section, the dimensions drifting downward from the first end of the molding section to the second end of the molding section.

2. The molding section of claim 1 wherein the first end of the angled face is coped.

3. The molding section of claim 2 wherein the other second end of the angled face portion is straight.

4. The molding section of claim 3 wherein the molding section is formed by vacuum molding.

5. The molding section of claim 4 wherein the dimension difference is formed during molding.

6. The molding of claim 1 wherein the angled portion includes a vertical wall and the dimension of the vertical wall varies from a larger dimension at the first end of the molding section, to a smaller dimension at the second end of the molding section.

7. The molding of claim 1 wherein the adhesive on the upper surface of the horizontal alignment portion covers substantially the entire upper surface of the horizontal alignment portion.

8. A method of installing a modular molding system about a ceiling in a room comprising the steps of:

providing a plurality of molding sections having horizontal alignment portions and angled face portions and first and second ends wherein one of the first and second ends is of a size greater than the other to allow for sequential molding sections to overlap and nest;

overlapping sequential molding sections to create a molding of a desired length;

adhering overlapping sequential molding sections together; and adhering the molding sections to a ceiling.

9. The method of claim 8 further comprising the step of forming a corner by abutting angled ends of two molding sections at a corner formed by two vertical walls and a ceiling.

10. The method of claim 8 further comprising the step of adhering a second molding section to the first molding section by placing an angled end of the second molding section over a straight end of the first molding section.

11. A molding system comprising:

a plurality of molding sections each having:

an angled face portion having an upper edge, a lower edge, a first straight end and a second mitered end wherein the second mitered end has a dimension greater than the dimension of the first straight end to allow the second mitered end to overlap the first straight end of an adjacent molding, dimensions of the angled face portion drifting downward from the second mitered end to the first straight end.

a horizontal alignment portion having a forward edge, a rear edge, an upper surface and first and second ends, the horizontal alignment portion formed integrally with the angled face portion and joined with the upper edge of the angled face portion along the forward edge;

wherein the molding sections are attachable together to form a molding of a desired length, and the molding sections are adhered to a ceiling.

12. The molding system of claim 11 wherein the dimension difference is manufactured into the molding section by incorporating a drift into each molding section.

13. The molding system of claim 12 wherein the drift is incorporated in the smallest dimension of the decorative angled face portion of the molding section.

14. The method of claim 13 wherein the angled faced portions of the molding sections each have a straight end and an angled end, and the method further comprises overlapping straight end with the angled ends of an adjacent molding section to form a molding of a desired length.

15. The molding system of claim 12 wherein it is formed by vacuum molding.

16. The molding system of claim 14 wherein an adhesive is located on a rear side of the angled face, at the angled end.

* * * * *